US008721373B2

(12) United States Patent
Suzuki et al.

(10) Patent No.: US 8,721,373 B2
(45) Date of Patent: May 13, 2014

(54) CONNECTOR

(75) Inventors: Masakazu Suzuki, Yokkaichi (JP); Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/611,032

(22) Filed: Sep. 12, 2012

(65) Prior Publication Data

US 2013/0078843 A1 Mar. 28, 2013

(30) Foreign Application Priority Data

Sep. 24, 2011 (JP) ..... 2011-208290

(51) Int. Cl.
*H01R 13/502* (2006.01)

(52) U.S. Cl.
USPC ..... 439/701; 439/589

(58) Field of Classification Search
USPC ..... 439/701, 752, 587–589
See application file for complete search history.

(56) References Cited

U.S. PATENT DOCUMENTS

| | | | | |
|---|---|---|---|---|
| 5,782,657 | A * | 7/1998 | Wolla et al. | 439/595 |
| 5,928,038 | A * | 7/1999 | Berg et al. | 439/752 |
| 6,004,153 | A * | 12/1999 | Myer et al. | 439/352 |
| 6,004,158 | A * | 12/1999 | Ward | 439/595 |
| 6,071,147 | A * | 6/2000 | Tsukamoto | 439/587 |
| 6,179,671 | B1 * | 1/2001 | Ohsumi | 439/752 |
| 6,203,348 | B1 * | 3/2001 | Fukuda | 439/275 |
| 6,254,431 | B1 * | 7/2001 | Murakami et al. | 439/587 |
| 6,383,020 | B2 * | 5/2002 | Taguchi et al. | 439/587 |
| 6,514,098 | B2 * | 2/2003 | Marpoe et al. | 439/352 |
| 6,575,788 | B2 * | 6/2003 | Nimura et al. | 439/595 |
| 6,599,153 | B2 * | 7/2003 | Nishide | 439/681 |
| 6,638,109 | B2 * | 10/2003 | Kurimoto et al. | 439/595 |
| 7,114,991 | B2 * | 10/2006 | Shiga et al. | 439/587 |
| 7,201,599 | B2 * | 4/2007 | Holub | 439/357 |
| 7,351,102 | B2 * | 4/2008 | Cykon et al. | 439/587 |
| 7,448,908 | B2 * | 11/2008 | Iwahori et al. | 439/587 |
| 7,722,414 | B2 * | 5/2010 | Tanaka et al. | 439/757 |
| 7,727,016 | B2 * | 6/2010 | Lamdiziz et al. | 439/587 |
| 8,133,076 | B2 * | 3/2012 | Nakamura | 439/595 |
| 8,215,987 | B2 * | 7/2012 | Yoshioka et al. | 439/587 |
| 8,272,895 | B2 * | 9/2012 | Park | 439/587 |
| 8,419,485 | B2 * | 4/2013 | Stausser et al. | 439/752 |
| 8,485,838 | B2 * | 7/2013 | Kataoka | 439/271 |
| 8,568,168 | B2 * | 10/2013 | Han | 439/587 |

(Continued)

FOREIGN PATENT DOCUMENTS

EP 2112715 10/2009

*Primary Examiner* — Ross Gushi
(74) *Attorney, Agent, or Firm* — Gerald E. Hespos; Michael J. Porco; Matthew T. Hespos

(57) ABSTRACT

A connector (A) includes a resiliently deformable resilient receiving portion (35) arranged to traverse an opening area of a lock hole (32) formed in a holder (30) and linked to an inner surface of the lock hole (32) at links (36) on opposite ends in a longitudinal direction. A locking rib (15) projects from a lock projection (12) formed in a housing (10) and extends along the longitudinal direction of the resilient receiving portion (35). The locking rib (15) causes the resilient receiving portion (35) to curve and deform in the process of assembling the housing (10) and the holder (30). Escaping edges (18) are formed on opposite longitudinal ends of a projecting edge (16) of the locking rib (15). The escaping edges (18) are oblique to the longitudinal direction of the resilient receiving portion (35) that is not resiliently deformed, and substantially face the links (36).

14 Claims, 9 Drawing Sheets

(56) References Cited

U.S. PATENT DOCUMENTS

| | | | | |
|---|---|---|---|---|
| 2002/0039862 | A1* | 4/2002 | Nishide | 439/701 |
| 2003/0176090 | A1 | 9/2003 | Kozono et al. | |
| 2004/0077227 | A1* | 4/2004 | Wu | 439/701 |
| 2004/0092163 | A1* | 5/2004 | Nagayasu et al. | 439/587 |
| 2004/0110427 | A1* | 6/2004 | Shi et al. | 439/752 |
| 2008/0280489 | A1* | 11/2008 | Tanaka et al. | 439/598 |
| 2011/0086544 | A1* | 4/2011 | Yoshioka et al. | 439/587 |
| 2012/0077377 | A1* | 3/2012 | Han | 439/587 |
| 2012/0129392 | A1* | 5/2012 | Fujisaki | 439/587 |
| 2013/0078843 | A1* | 3/2013 | Suzuki et al. | 439/352 |

* cited by examiner

CONNECTOR

BACKGROUND OF THE INVENTION

1. Field of the Invention

The present invention relates to a connector.

2. Description of the Related Art

U.S. Pat. No. 6,599,153 discloses a connector with a housing that has a plurality of terminal accommodating chambers. A one-piece rubber plug is sandwiched between the rear surface of the housing and the front surface of a holder provided behind the housing. A lock projection projects back from the rear surface of the housing, passes through the one-piece rubber plug and engages in a lock hole in the front surface of the holder for holding the holder on the housing. Thus, the one-piece rubber plug can be mounted with the outer peripheral surface thereof exposed.

The lock projection disclosed in U.S. Pat. No. 6,599,153 is deformed resiliently in a direction crossing a projecting direction thereof in the process of engaging the lock projection and the lock hole. FIGS. 9 to 12 show a structure that would enable a lock projection to engage a lock hole without resiliently deforming the lock projection. As shown in FIG. 9, lock projections 102 project from the rear surface of a housing 100 and pass through a one-piece rubber plug 101, and a locking projection 103 is formed at a projecting end of each lock projection 102 and projects in a direction crossing a projecting direction of the lock projection 102. On the other hand, a holder 104 is formed with lock holes 105. Resilient receiving portions 106 traverse in a direction crossing projecting directions of the lock projections 102 and have opposite ends supported on the inner surfaces of the lock holes 105, as shown in FIGS. 11 and 12.

The lock projections 102 enter the lock holes 105 in the process of mounting the holder 104 into the housing 100 and the resilient receiving portions 106 deform away from the locking projections 103 due to interference with the locking projections 103, as shown in FIG. 12. The resilient receiving portions 106 resiliently restore when the holder 104 is assembled properly and engage the locking projections 103, as shown in FIG. 11, to lock the holder 104 and the housing 100 in an assembled state.

Links 107 are formed at opposite ends of the resilient receiving portion 106 and join to the inner surface of the lock hole 105. The links 107 deform to a large extent when the resilient receiving portion 106 is deformed as shown in FIG. 12. Thus, stresses are concentrated on the links 107 and improper deformation or breakage, such as a crack, may occur. The reliability of a lock function of the resilient receiving portion 106 and the lock projection 102 is reduced if the links improperly deform or break.

The invention was completed in view of the above situation and an object thereof is to provide a connector with excellent locking reliability.

SUMMARY OF THE INVENTION

The invention relates to a connector with a housing that has at least one terminal accommodating chamber. The connector also has at least one connector forming member to be assembled with the housing. At least one lock projection projects from either one of the housing and the connector forming member and at least one lock hole is formed in the other of the housing and the connector forming member for receiving the lock projection. At least one resiliently deformable receiving portion traverses an opening area of the lock hole and is linked to the inner surface of the lock hole at links on opposite longitudinal ends. At least one locking rib projects from the lock projection and extends along the longitudinal direction of the resilient receiving portion. The locking rib is configured to press, resiliently curve and deform the resilient receiving portion in the process of assembling the housing and the connector forming member. At least one escaping edge is formed on the locking portion in a longitudinal direction, oblique to the longitudinal direction of the resilient receiving portion that is not resiliently deformed and faces the links.

Opposite ends of the projecting end edge contact the resilient receiving portion when the resilient receiving portion is curved and deformed to the maximum extent if the escaping edge is not formed on the projecting edge of the locking portion. On the other hand, the escaping edge formed on the opposite ends of the projecting edge contacts the resilient receiving portion when the resilient receiving portion is curved and deformed to the maximum extent. Therefore, a lock function of the resilient receiving portion and the lock projection has excellent reliability.

Plural escaping edge portions preferably are formed on opposite ends of a projecting edge of the locking portion in a longitudinal direction.

The escaping edge may contact the resilient receiving portion at positions closer to the center than the opposite ends of the projecting edge. Thus, a space between the two lateral contact positions of the escaping edges with the resilient receiving portion may be narrower than a spacing (i.e. maximum width of the locking portion) between two contact positions of the projecting edge (i.e. opposite ends of the projecting end edge) when the escaping edges are not formed. The deformation of the resilient receiving portion is reduced and stress generated on the links on the opposite ends of the resilient receiving portion is reduced as the space between the two contact positions of the projecting edge with the resilient receiving portion becomes narrower. Thus, improper deformation and breakage of the links is prevented. Therefore, a lock function by the engagement of the resilient receiving portion and the lock projection has excellent reliability.

One or more cut portions may be provided for locally reducing the width of the resilient receiving portion at the links. Thus, stresses generated when the resilient receiving portion is deformed are reduced, thereby reliably preventing improper deformation and breakage at the links and improving reliability of the lock function.

The cut portions preferably are formed by cutting a warping edge that extends along the longitudinal direction of the resilient receiving portion and is curved and deformed concavely when the resilient receiving portion is deformed.

Improper deformation and breakage caused by an increase in stresses at the links is likely to appear as a crack caused by a tensile load on the concavely curved and deformed warping edge. However, the warping edge that is curved and deformed concavely is recessed, in the present invention. Therefore, improper deformation and breakage at the links can be prevented more effectively.

A space between contact positions of the escaping edges with the resilient receiving portion is narrower than a maximum width of the locking portion.

The escaping edge may be arcuate, bent or rounded.

The escaping edge preferably is closer to the center than the links on the concave deformation side warping edge of the lock projection.

The connector further comprises a resilient member to be held in contact with the housing and the connector forming member is configured to hold the resilient member sandwiched between the connector forming member and the housing.

The connector forming member preferably has at least one insertion hole corresponding to the terminal accommodating chamber.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
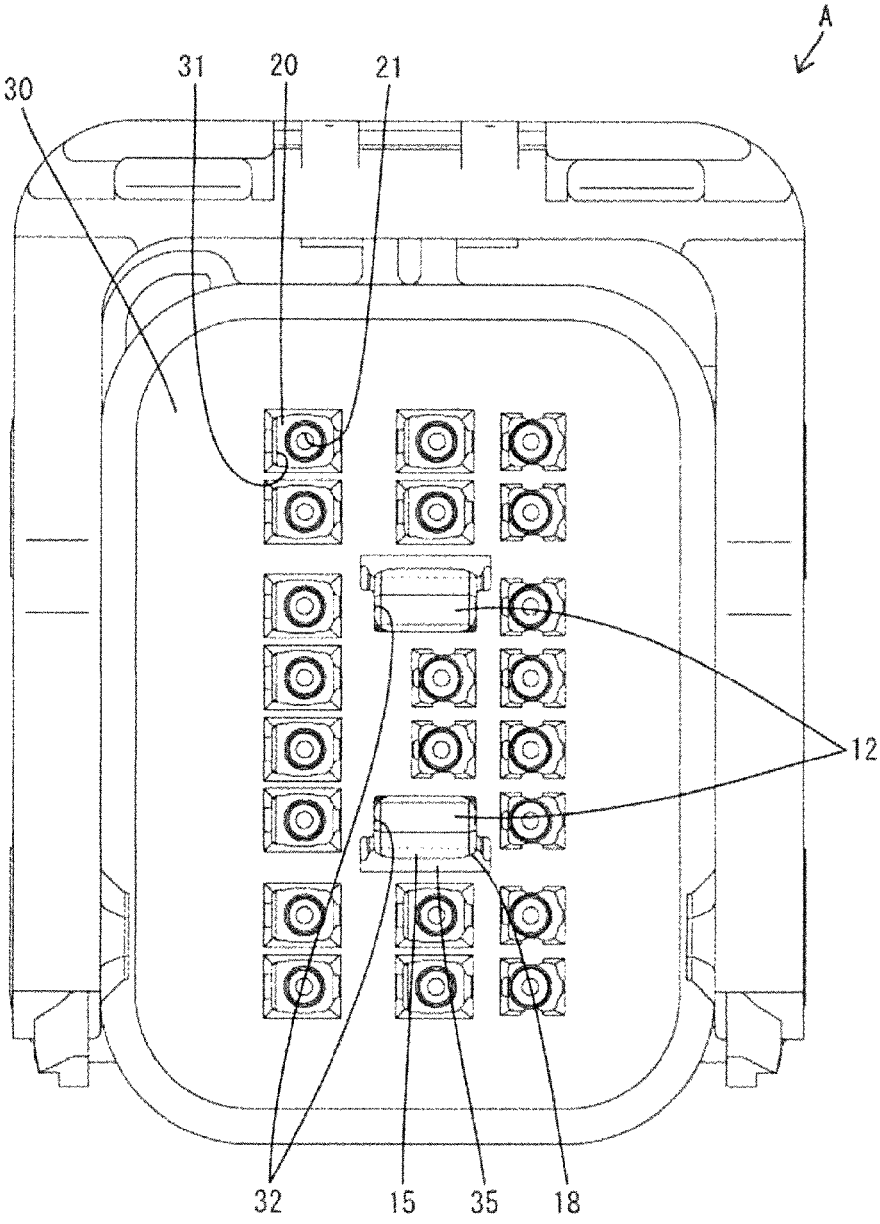
FIG. 1 is a rear view of a connector according to one embodiment.
Figure 2:
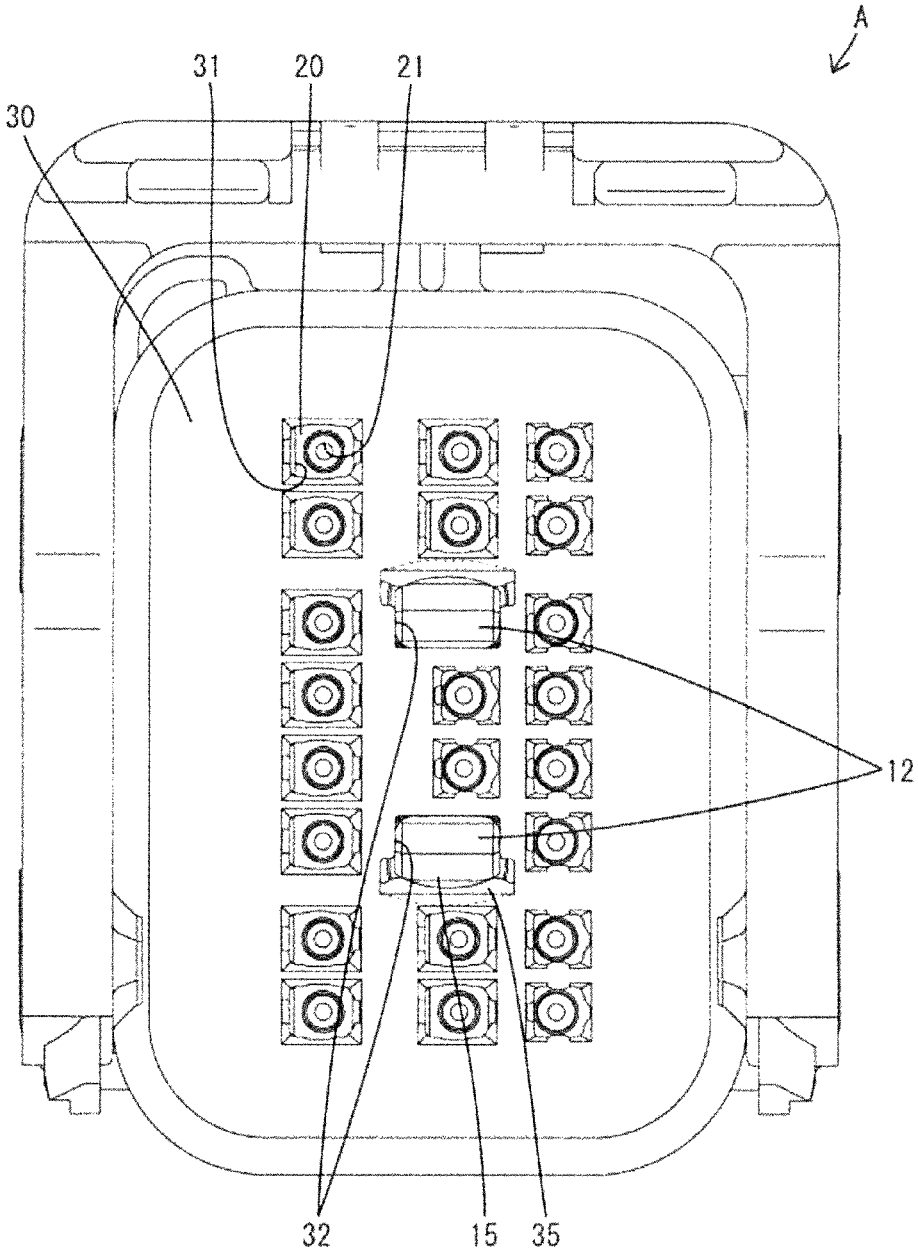
FIG. 2 is a rear view showing resilient receiving portions resiliently deformed.
Figure 4:
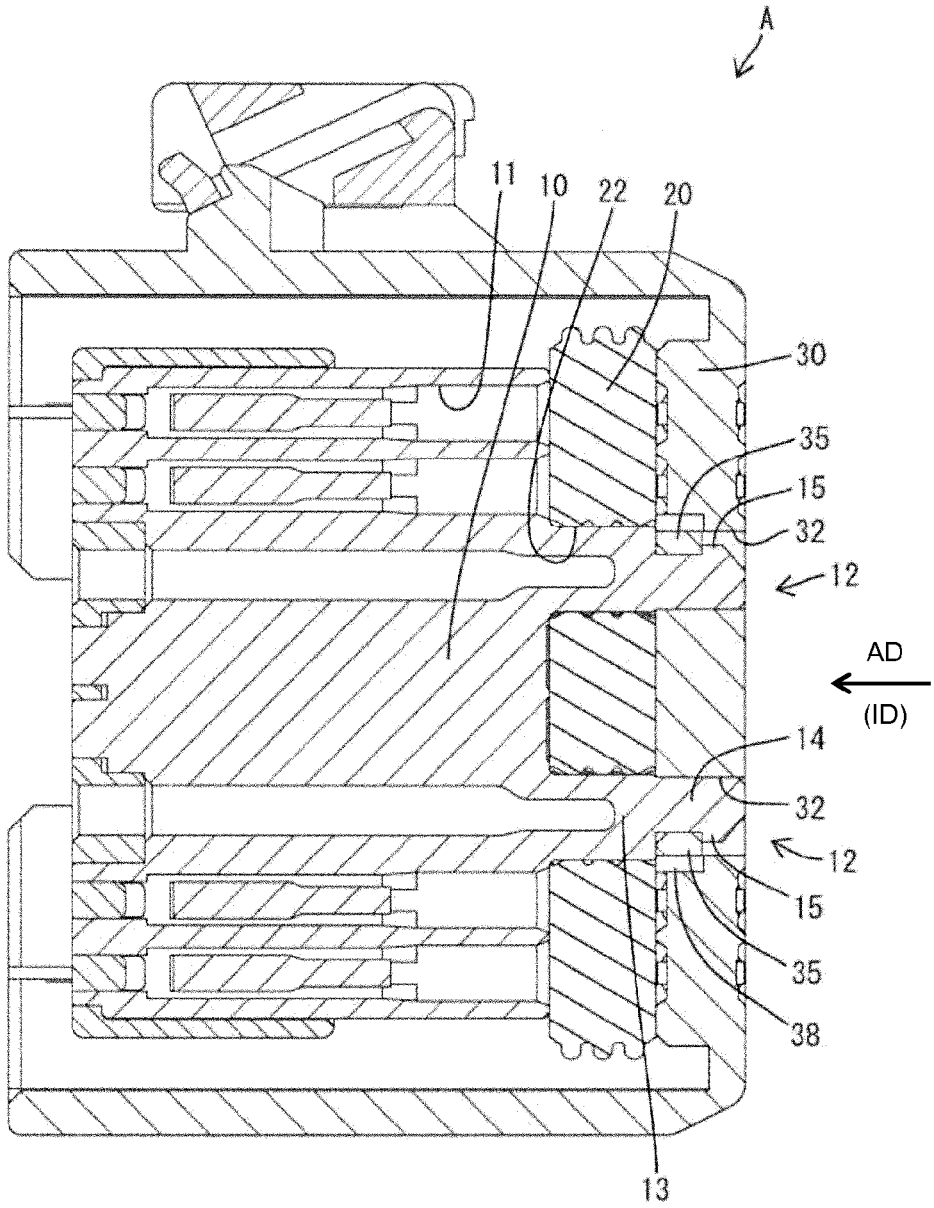
FIG. 4 is a section of the connector.

A connector in accordance with the invention is identified generally by the letter A in FIGS. 1, 2 and 4. The connector A includes a housing 10 made e.g. of synthetic resin and has terminal accommodating chambers 11. A resilient member (particularly a one-piece rubber plug) 20 is held in contact with the rear surface of the housing 10. A holder 30 or connector forming member is made e.g. of synthetic resin and is configured to hold the resilient member 20 by sandwiching the resilient member 20 between the holder 30 and a rear surface of the housing 10. Terminal fittings (not shown) of a known form are mounted in the terminal accommodating chambers. In the following description, a connecting end with a mating connector (not shown) is referred to as the front.

Figure 3:
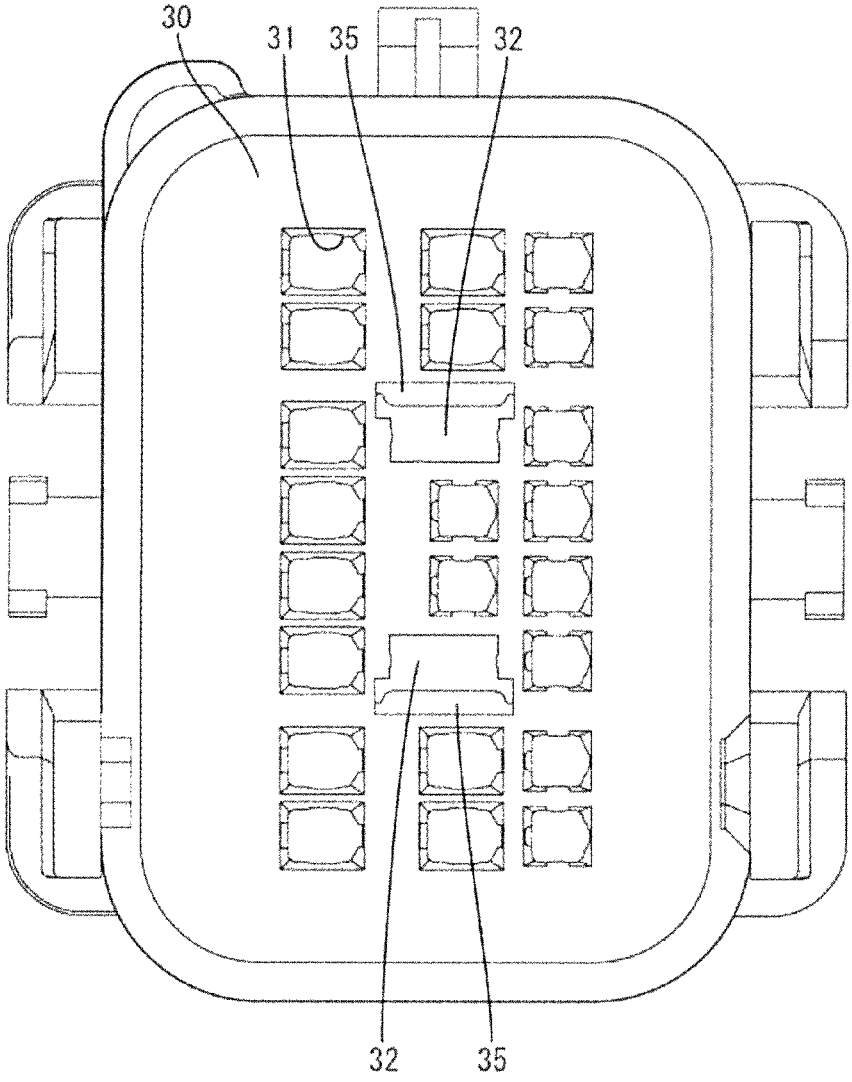
FIG. 3 is a rear view of a holder.

The housing 10 is formed with two vertically symmetric lock projections 12 that project back from the rear surface of the housing 10. The resilient member 20 has seal holes 21 corresponding to the respective terminal accommodating chambers 11 as shown in FIGS. 1 and 2 and two vertically symmetric through holes 22 for allowing penetration of the lock projections 12, as shown in FIG. 4. The holder 30 has insertion holes 31 corresponding to the respective terminal accommodating chambers 11 and the seal holes 21 and two vertically symmetric lock holes 32 with which the lock projections 12 are to be engaged, as shown in FIGS. 1 to 3.

As shown in FIG. 4, the lock projections 12 engage the lock holes 32 to lock the holder 30 and the resilient member 20 in an assembled state with the housing 10. The connector A adopts a locking structure for locking the lock projections 12 passed through the resilient member 20 with the lock holes 32, the outer peripheral surface of the resilient member 20 is held in close contact with the inner periphery of a fitting tube portion of a mating connector (not shown) to which the connector A is to be connected.

The lock projections 12 are vertically symmetric and for simplicity, only the lock projection 12 at a lower side is described.

Figure 5:
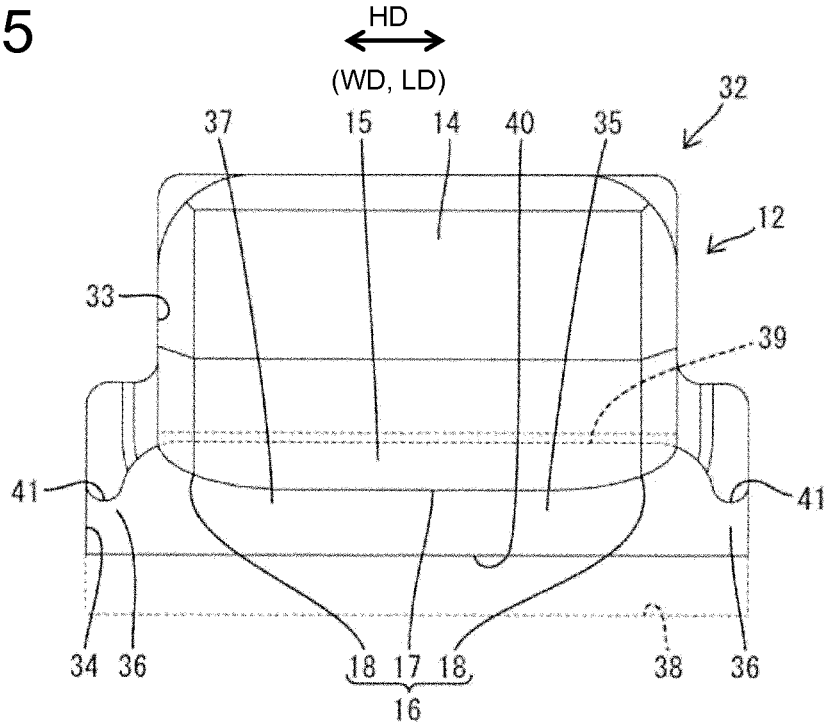
FIG. 5 is a partial enlarged rear view of FIG. 1.
Figure 6:
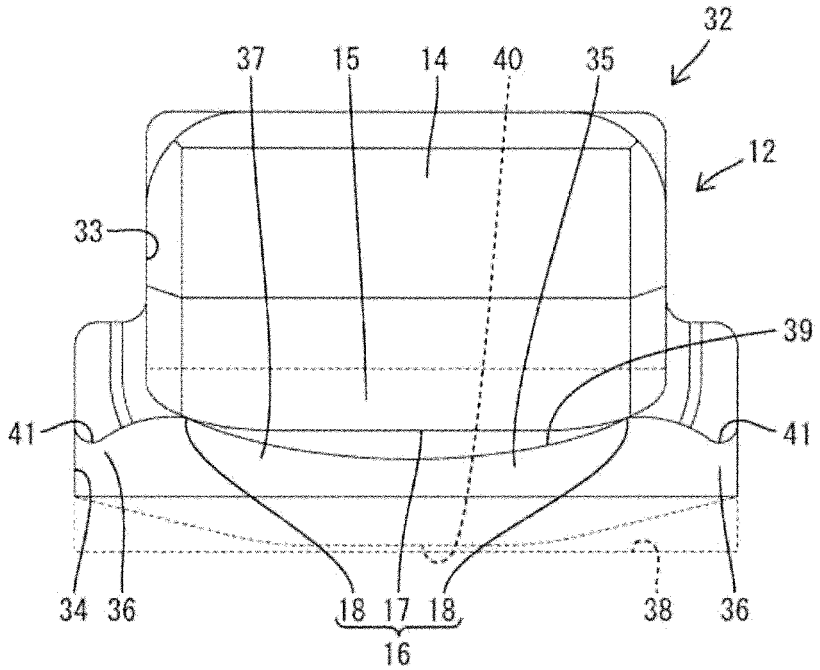
FIG. 6 is a partial enlarged rear view of FIG. 2.
Figure 8:
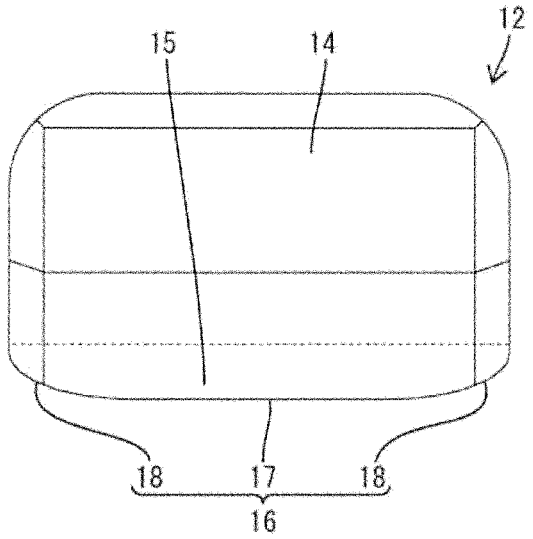
FIG. 8 is an enlarged rear view showing the shape of a lock projection.
Figure 9:
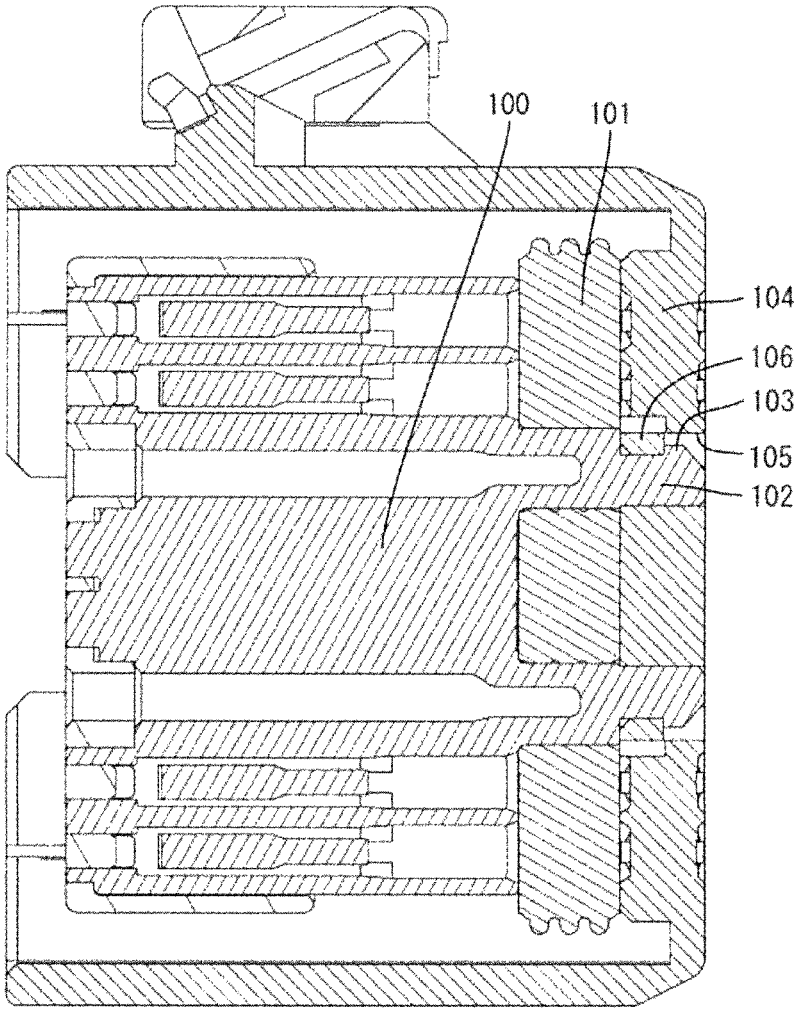
FIG. 9 PRIOR ART
FIG. 9 is a section of a conventional connector.
Figure 10:
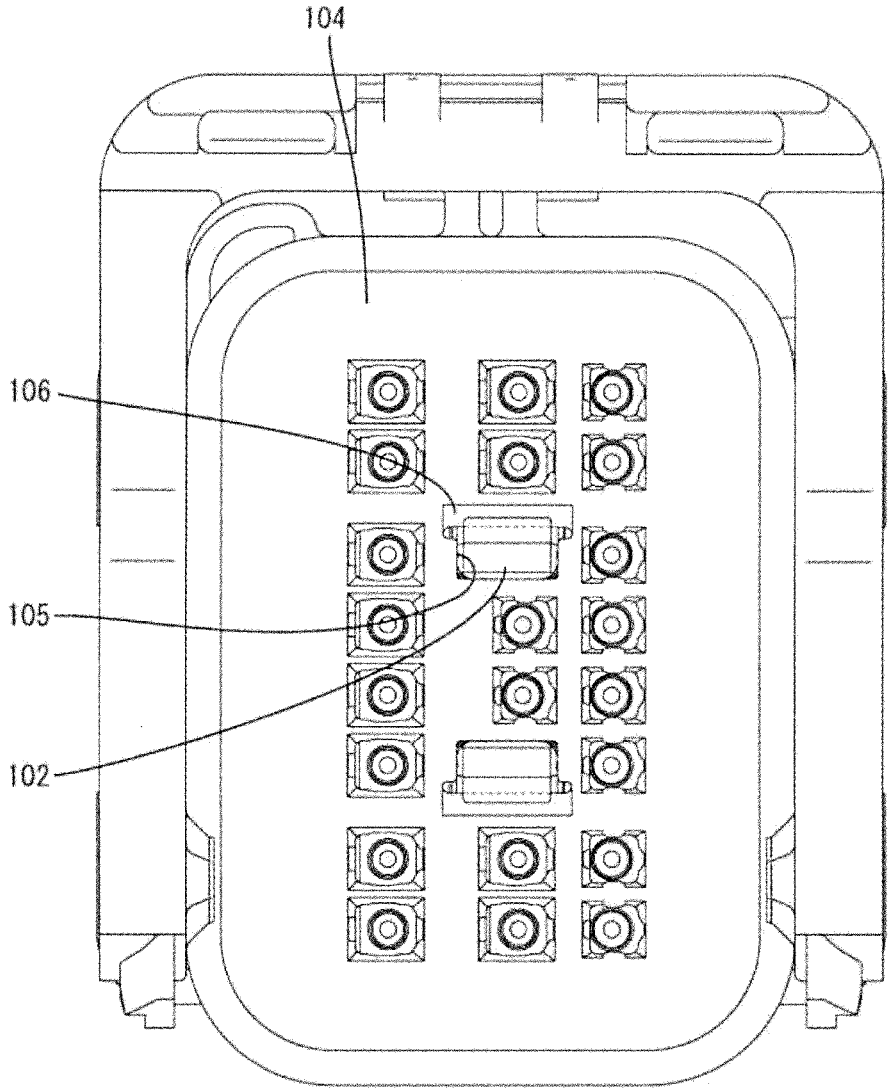
FIG. 10 PRIOR ART
FIG. 10 is a rear view of the conventional connector.
Figure 11:
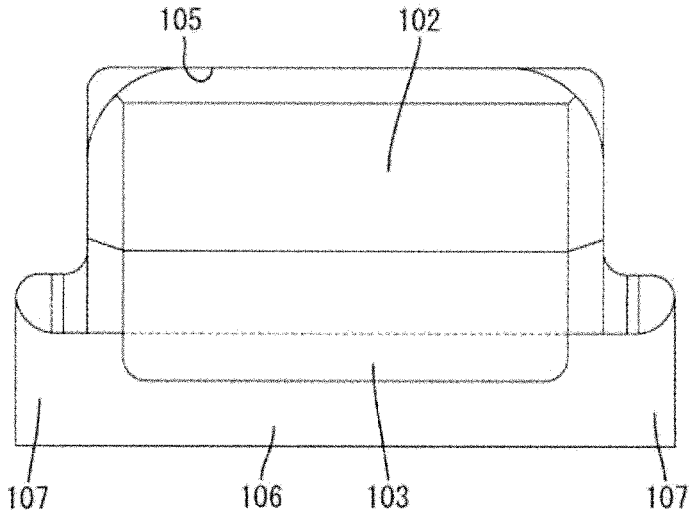
FIG. 11 PRIOR ART
FIG. 11 is a partial enlarged rear view of FIG. 10.
Figure 12:
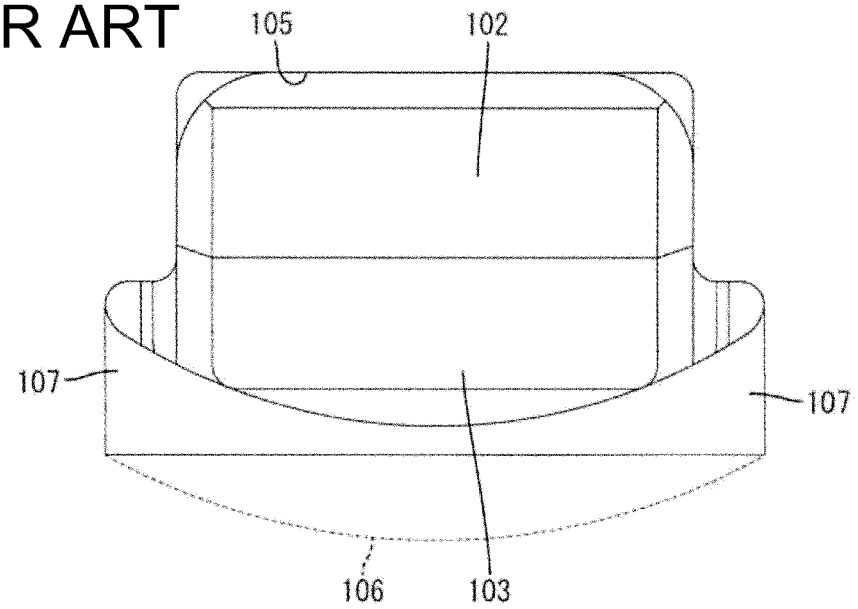
FIG. 12 PRIOR ART
FIG. 12 is a partial enlarged rear view of the conventional connector showing a state where a resilient receiving portion is resiliently deformed.

As shown in FIG. 4, the lock projection 12 has a penetrating portion 13 that penetrates through the through hole 22 of the resilient member 20 in a fluid or liquid tight manner. A lock 14 extends back from the penetrating portion 13 and is inserted into the lock hole 32. As shown in FIGS. 5, 6 and 8, the lock 14 has a wide rectangular rear shape in which a width (dimension in a horizontal direction HD) is larger than a vertical dimension (height). A locking rib 15 that is long in the horizontal direction HD is formed at a projecting rear end part of the lock projection 12.

The locking rib 15 projects laterally out substantially orthogonal to an assembling direction AD with the housing 10 and extends over substantially the entire width from the lower surface of the lower lock 14. The rear surface of the locking rib 15 is inclined with respect to an inserting direction ID of the lock projection 12 into the lock hole 32 while the front surface of the locking rib 15 is substantially perpendicular to the inserting direction ID. The locking rib 15 has a projecting edge 16 with a straight edge portion 17 that extends along a wide range along a central part of the locking rib 15 excluding left and right end parts. A height difference between the lower surface of the lock 14 and the straight edge portion 17 (i.e. a projecting distance of an area of the locking rib 15 where the straight edge portion 17 is formed from the lateral surface of the lock 14) is substantially constant over the entire width of the straight edge portion 17.

The lock holes 32 are substantially vertically symmetric and hence for simplicity only the lower lock hole 32 is described.

Figure 7:
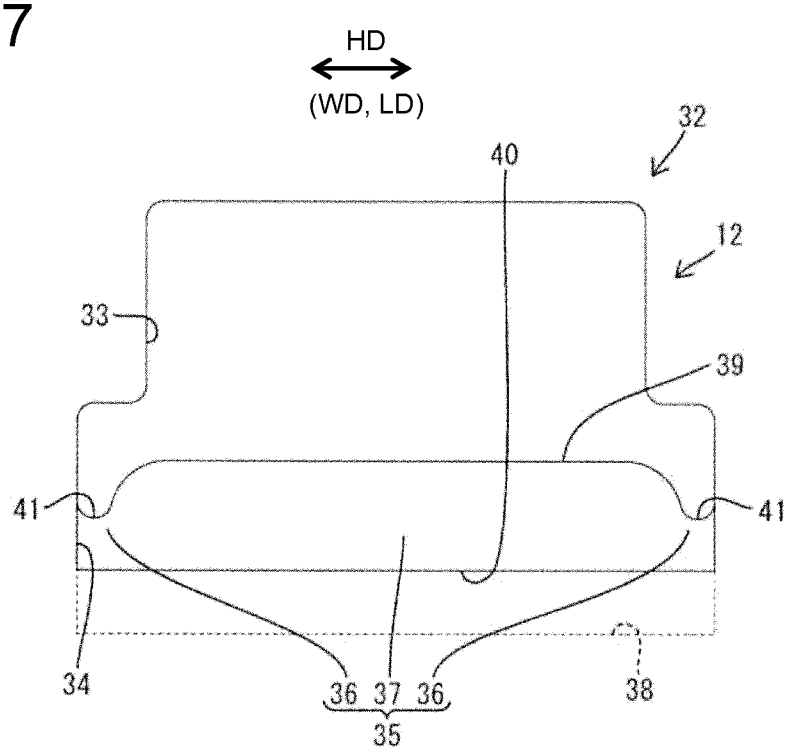
FIG. 7 is an enlarged rear view showing the shapes of a lock hole and the resilient receiving portion.

As shown in FIGS. 5 to 7, an opening area of the lock hole 32 includes a wide rectangular positioning area 33 for receiving the lock 14 and a wide rectangular locking area 34 arranged below the positioning area 33 to communicate vertically with the positioning area 33. The locking area 34 is wider than the positioning area 33, and left and right end parts of the locking area 34 project out from left and right ends of the positioning area 33 in the width direction WD. Further, the opening of the positioning area 33 has substantially the same size and shape on the front and rear surfaces of the holder 30.

The opening widths of the locking area 34 on the front and rear surfaces of the holder 30 are substantially equal. However, a vertical opening range of the locking area 34 extends farther down on the front surface of the holder 30 than on the rear surface of the holder 30. Thus, as shown in FIG. 4, the lower surface of the lock hole 32 is lower at the front side than at the rear side with a step formed between the front and rear.

As shown in FIGS. 5 to 7, a long and narrow resilient receiving portion 35 is formed in the lock hole 32 and traverses the locking area 34 in a lateral direction crossing both the inserting direction ID of the lock projection 12 into the lock hole 32 and a projecting direction of the locking rib 15 from the lock 12. The resilient receiving portion 35 is joined to left and right inner surfaces of the locking area 34 at links 36 on opposite ends of the resilient receiving portion 35 in its longitudinal direction LD. A deforming portion 37 is defined at a part of the resilient receiving portion 35 excluding the links 36 on the opposite ends. Thus, the links 36 and the deforming portion 37 define part of the resilient receiving portion 35. Further, the upper surface of the deforming portion 37 is at a substantially right angle to the inserting direction ID of the lock projection 12 into the lock hole 32.

The resilient receiving portion 35 is formed so that the deforming portion 37 is resiliently deformable to be curved down or out in a direction crossing the inserting direction ID of the lock projection 12 into the lock hole 32. The resilient receiving portion 35 is arranged at a front end in the locking area 34. As shown in FIGS. 4 to 7, a space of the locking area 34 below the resilient receiving portion 35 defines a deformation space 38 for permitting a downward curved deformation of the resilient receiving portion 35.

As shown in FIGS. 5 to 7, a concave deformation side warping edge 39 extends in the longitudinal direction LD over substantially the entire length of the upper surface of the resilient receiving portion 35 in the positioning area 33 and is curved concavely and deformed when the resilient receiving portion 35 is deformed. On the other hand, a convex deformation side warping edge 40 extends in the longitudinal direction LD over substantially the entire length of the lower surface of the resilient receiving portion 35 and is convexly curved and deformed when the resilient receiving portion 35 is deformed. The concave deformation side warping edge 39 and the convex deformation side warping edge portion 40 both are horizontal and flat when the resilient receiving portion 35 is not deformed.

The holder 30 is mounted from behind to the housing 10 in which the resilient member 20 has been mounted. As a result, the locks 14 are inserted into the lock holes 32 and the locking ribs 15 contact and press the resilient receiving portions 35 and cause the resilient receiving portions 35 to curve and deform. More particularly, the resilient receiving portions 35 are curved and deformed to project down in the lower lock hole 32 and to project up in the upper lock hole 32. The projecting edges 16 of the locking ribs 15 contact the resilient receiving portions 35 as the assembling of the holder 30 proceeds and cause the resilient receiving portions 35 to deform to a maximum extent (i.e. a radius of curvature of the warping edges are smallest) as shown in FIG. 6.

The locking ribs 15 pass the resilient receiving portions 35 when the holder 30 reaches a proper assembled position, as shown in FIG. 4, and the resilient receiving portions 35 restore resiliently due to their resilient restoring forces. The resilient receiving portions 35 engage the locking ribs 15 from the front, as shown in FIGS. 4 and 5, to lock the holder 30 in the assembled state.

The links 36 at the opposite ends of the resilient receiving portion 35 are linked to the inner surface of the lock hole 32. The deforming portion 37 also curves and deforms when the resilient receiving portion 35 is deformed, as shown in FIG. 6. The amount of deformation and stresses of the links 36 are larger than those of the deformation portion 37 and this concentration of stress may cause the links 36 to deform improperly, crack or break, thereby reducing the reliability of the lock function. However, the lock projection 12 and the resilient receiving portion 35 are configured to ensure reliable locking as described in detail below.

The left and right ends of the projecting edge 16 of the locking rib 15 press the resilient receiving portion 35 when the resilient receiving portion 35 is deformed resiliently to the maximum extent in the process of assembling the holder 30. Further, the links 36 on the opposite ends of the resilient receiving portion 35 are at the outer sides of the left and right ends of the locking rib 15 in the width direction WD. Bilaterally symmetrical escaping edges 18 are formed on the left and right ends of the projecting edge portion 16 of the locking rib 15. The escaping edges 18 are oblique to the straight edge portion 17 (longitudinal direction LD of the resilient receiving portion 35) when the resilient receiving portion 35 is not resiliently deformed and substantially face the links 36 when viewed from behind and in the direction parallel to the inserting direction ID of the lock projection 12 into the lock hole 32. These escaping edge portions 18 are rounded and are at positions closer to the center than the links 36 on the concave deformation side warping edge 39 of the lock projection 12. The escaping edges 18 and the straight edge portion 17 form part of the projecting edge 16 of the locking rib 15.

If the escaping edges 18 are not formed on the projecting edge 16 of the locking rib 15, the opposite ends of the projecting end edge contact the resilient receiving portion 35 when the resilient receiving portion 35 is curved and deformed to the maximum extent. On the other hand, if the escaping edges 18 are formed on the opposite ends of the projecting edge 16, the escaping edges 18 contact the resilient receiving portion 35 when the resilient receiving portion 35 is curved and deformed to the maximum extent. The escaping edges 18 contact the resilient receiving portion 35 at positions closer to the center than the opposite ends of the projecting edge 16. Thus, a spacing between the left and right contact positions of the escaping edges 18 with the resilient receiving portion 35 is narrower than a spacing (i.e. maximum width of the locking rib 15) between two contact positions of the projecting edge 16 (i.e. substantially opposite ends of the projecting edge) when the escaping edges 18 are not formed. As the spacing between the two contact positions of the projecting edge 16 with the resilient receiving portion 35 becomes narrower, the amount of resilient deformation of the resilient receiving portion 35 is reduced and stresses generated on the links 36 on opposite ends of the resilient receiving portion 35 are reduced, thereby preventing improper deformation and breakage of the links 36. Therefore, the lock function by the engagement of the resilient receiving portion 35 and the lock projection 12 has excellent reliability.

Stress concentration on the links 36 is reduced further by forming cuts 41 in the links 36. The cuts 41 are configured for locally reducing the width of the resilient receiving portion 35 in directions parallel to a displacing direction when the resilient receiving portion 35 is deformed resiliently by the locking rib 15. Improper deformation and breakage caused by an increase in stress at the links 36 often begins as a crack due to a tensile load on the concave deformation side warping edge 39. However, the cuts 41 are formed on the concave deformation side warping edge 39 that is curved and deformed concavely when the resilient receiving portion 35 is deformed resiliently.

The cuts 41 locally reduce the width of the resilient receiving portion 35 at the links 36 to reduce stress generated when the resilient receiving portion 35 is deformed, thereby preventing improper deformation and breakage at the links 36 and improving the reliability of the lock function. In addition, the cuts 41 are formed by recessing the concave deformation side warping edge 39 that often is cracked due to the action of a tensile load, thereby preventing improper deformation and breakage at the links 36 more effectively.

The invention is not limited to the above described embodiment. For example, the following embodiments also are included in the scope of the invention.

The escaping edges are arcuate in the above embodiment, but they may be straight.

The housing is formed with the lock projections and the holder is formed with the lock holes in the above embodiment, but the holder may be formed with the lock projections and the housing may be formed with the lock holes.

Although the deformation space for the resilient receiving portion is open only in the front surface of the holder in the above embodiment, it may be open in the both front and rear surfaces of the holder or may be open only in the rear surface of the holder.

The cuts for reducing the width of the links are formed only on the concave deformation side warping edge that is curved and deformed concavely in the above embodiment. However, the cuts may be formed only on the convex deformation side warping edge or may be formed on both the concave deformation side warping edge and the convex deformation side warping edge.

The cuts are formed by recessing the warping edge. However, holes may penetrate the links instead of having recesses on the warping edge.

The cuts for reducing the width of the linking portions particularly are formed in the above embodiment. However, the width of the resilient receiving portion may be constant over the entire length without forming the cuts at the links.

The lock projections and the lock holes particularly are vertically symmetric in the above embodiment, but symmetry may not be required.

Two lock projections and two lock holes are provided in the above embodiment. However, one lock projection and lock hole may be provided or three or more of the lock projections and lock holes may be provided.

The lock holes open in front and rear surfaces of the holder in the above embodiment, but may not open in the rear surface of the holder.

The housing and the holder are locked in the above embodiment. However, the invention also can be applied for assembling the housing and a member other than the holder (e.g. a retainer for retaining terminal fittings and/or for detecting inserted states of the terminal fittings or a front member forming front end parts of the housing).

What is claimed is:

1. A connector, comprising:

a housing including at least one terminal accommodating chamber;

at least one connector forming member to be assembled with the housing;

at least one lock projection projecting from one of the housing and the connector forming member;

at least one lock hole formed in the other of the housing and the connector forming member and configured to receive the lock projection;

at least one resiliently deformable resilient receiving portion arranged to traverse an opening area of the lock hole and linked to an inner surface of the lock hole at links on opposite ends in a longitudinal direction;

at least one locking rib projecting from the lock projection and extending along the longitudinal direction of the resilient receiving portion, the locking rib being configured to press the resilient receiving portion to resiliently curve and deform the resilient receiving portion in the process of assembling the housing and the connector forming member; and escaping edges formed on the locking rib at positions in the longitudinal direction substantially facing the links and being aligned oblique to the longitudinal direction of the resilient receiving portion when the resilient receiving portion is not deformed resiliently.

2. The connector of claim 1, wherein the escaping edges are formed on opposite ends of a projecting edge of the locking rib in the longitudinal direction.

3. The connector of claim 2, further comprising cuts for locally reducing the width of the resilient receiving portion at the links.

4. The connector of claim 3, wherein the cuts are formed by cutting a warping edge that extends along the longitudinal direction of the resilient receiving portion and that is curved concavely and deformed when the resilient receiving portion is deformed resiliently.

5. The connector of claim 1, wherein a spacing between contact positions of the escaping edges with the resilient receiving portion is narrower than a maximum width of the locking rib.

6. The connector of claim 1, wherein the escaping edge is rounded.

7. The connector of claim 1, wherein the escaping edge is closer to a center than the links on the concave deformation side warping edge of the lock projection.

8. The connector of claim 1, further comprising a resilient member to be held in contact with the housing, wherein the connector forming member is configured to hold the resilient member sandwiched between the connector forming member and the housing.

9. The connector of claim 8, wherein the connector forming member is formed with at least one insertion hole corresponding to the terminal accommodating chamber.

10. A connector, comprising:

a housing including at least one terminal accommodating chamber;

a resilient member in contact with a rear end of the housing;

a holder assembled with the housing for holding the resilient member in contact with the housing;

lock projections projecting from the rear end of the housing;

lock holes formed in the holder and configured to receive the lock projections, a resiliently deformable resilient receiving portion traversing an opening area of each of the lock holes and linked to an inner surface of the respective lock hole at links on opposite ends in a longitudinal direction; and a locking rib projecting from each of the lock projections and extending along the longitudinal direction of the resilient receiving portion, the locking ribs being configured to press the resilient receiving portions to resiliently curve and deform the resilient receiving portion in the process of assembling the housing and the holder, escaping edges formed on the locking rib at positions in the longitudinal direction in proximity to and inward of the links, the escaping edges being aligned oblique to the longitudinal direction of the resilient receiving portion when the resilient receiving portion is not deformed resiliently.

11. The connector of claim 10, further comprising cuts for locally reducing a width of the resilient receiving portion at the links.

12. The connector of claim 11, wherein the cuts are formed by cutting a warping edge that extends along the longitudinal direction of the resilient receiving portion and that is curved concavely and deformed when the resilient receiving portion is deformed resiliently.

13. The connector of claim 10, wherein a spacing between contact positions of the escaping edges with the resilient receiving portion is narrower than a maximum width of the locking rib.

14. The connector of claim 10, wherein the escaping edges are rounded.

* * * * *